US008951144B2

(12) United States Patent
Roach et al.

(10) Patent No.: US 8,951,144 B2
(45) **Date of Patent: *Feb. 10, 2015**

(54) COLORIZED DAMPING INDICATORS FOR CUSTOMIZED GOLF CLUB HEADS

(75) Inventors: Ryan L. Roach, Carlsbad, CA (US); Tim A. Beno, San Diego, CA (US); Andrew Curtis, Solana Beach, CA (US); Michael S. Yagley, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 151 days.

This patent is subject to a terminal disclaimer.

(21) Appl. No.: 13/418,728

(22) Filed: Mar. 13, 2012

(65) Prior Publication Data

US 2012/0190478 A1 Jul. 26, 2012

Related U.S. Application Data

(63) Continuation-in-part of application No. 13/093,708, filed on Apr. 25, 2011, now Pat. No. 8,152,651, which is a continuation of application No. 12/622,178, filed on Nov. 19, 2009, now Pat. No. 7,938,738, which is a continuation of application No. 11/469,621, filed on Sep. 1, 2006, now Pat. No. 7,621,822.

(51) Int. Cl.
*A63B 53/04* (2006.01)
*A63B 59/00* (2006.01)

(52) U.S. Cl.
CPC ..... *A63B 53/047* (2013.01); *A63B 53/0487* (2013.01); *A63B 59/0092* (2013.01); *A63B 2053/0416* (2013.01); *A63B 2053/0491* (2013.01)
USPC ..... 473/329; 473/332; 473/349; 473/350

(58) Field of Classification Search
USPC ..... 473/324–350, 287–292
See application file for complete search history.

(56) References Cited

U.S. PATENT DOCUMENTS

| | | | | |
|---|---|---|---|---|
| 1,133,129 | A * | 3/1915 | Govan | 473/337 |
| 2,846,228 | A | 8/1958 | Reach | |
| 3,970,236 | A | 7/1976 | Rogers | |
| 4,398,965 | A | 8/1983 | Campau | |
| 4,425,161 | A | 1/1984 | Shibahashi | |

(Continued)

FOREIGN PATENT DOCUMENTS

| | | |
|---|---|---|
| JP | 4-51973 | 6/1990 |
| JP | 3032837 | 10/1996 |

(Continued)

OTHER PUBLICATIONS

Momentum Sign, Kokusai Kogyo Company Ltd., Golf Department, Apr. 1, 2005 (14 pages).

(Continued)

*Primary Examiner* — Sebastiano Passaniti
(74) *Attorney, Agent, or Firm* — Brown Rudnick LLP; Mark S. Leonardo

(57) ABSTRACT

The present invention is directed to a golf club having a playing characteristic that is communicated to a player based upon a vibration damping material that is colorized and visible from outside of the club head, thereby communicating to a golfer information about the playing characteristics of the club.

19 Claims, 2 Drawing Sheets

(56) References Cited

U.S. PATENT DOCUMENTS

| | | | | |
|---|---|---|---|---|
| 4,792,139 | A | 12/1988 | Nagasaki | |
| 4,927,180 | A | 5/1990 | Trundle | |
| 5,184,823 | A | 2/1993 | Desboilles | |
| 5,290,036 | A | 3/1994 | Fenton | |
| 5,425,535 | A * | 6/1995 | Gee | 473/300 |
| 5,431,396 | A | 7/1995 | Shieh | |
| 5,492,327 | A | 2/1996 | Biafore | |
| 5,503,583 | A | 4/1996 | Hippely | |
| 5,540,436 | A | 7/1996 | Boone | |
| 5,564,705 | A | 10/1996 | Kobayashi | |
| 5,593,356 | A | 1/1997 | Takeda | |
| 5,599,243 | A | 2/1997 | Kobayashi | |
| 5,616,088 | A | 4/1997 | Aizawa | |
| 5,658,208 | A * | 8/1997 | Shimasaki | 473/349 |
| 5,669,826 | A | 9/1997 | Chang | |
| 5,772,527 | A | 6/1998 | Liu | |
| 5,833,551 | A | 11/1998 | Vincent | |
| 5,967,903 | A * | 10/1999 | Cheng | 473/342 |
| 5,984,800 | A * | 11/1999 | Uebelhor | 473/251 |
| 5,993,329 | A | 11/1999 | Shieh | |
| 6,045,456 | A | 4/2000 | Best | |
| 6,077,171 | A | 6/2000 | Yoneyama | |
| 6,083,118 | A | 7/2000 | Martins | |
| 6,200,229 | B1 * | 3/2001 | Grace et al. | 473/324 |
| 6,206,790 | B1 | 3/2001 | Kubica | |
| 6,273,831 | B1 * | 8/2001 | Dewanjee | 473/324 |
| 6,290,609 | B1 * | 9/2001 | Takeda | 473/335 |
| 6,440,010 | B1 | 8/2002 | Deshmukh | |
| 6,443,857 | B1 | 9/2002 | Chuang | |
| 6,506,125 | B2 * | 1/2003 | Helmstetter et al. | 473/242 |
| 6,592,469 | B2 | 7/2003 | Gilbert | |
| 6,683,152 | B2 | 1/2004 | Wu | |
| 6,688,989 | B2 | 2/2004 | Best | |
| 6,719,641 | B2 * | 4/2004 | Dabbs et al. | 473/291 |
| 6,743,114 | B2 * | 6/2004 | Best | 473/291 |
| 6,743,117 | B2 | 6/2004 | Gilbert | |
| 6,773,361 | B1 | 8/2004 | Lee | |
| 6,835,144 | B2 | 12/2004 | Best | |
| 6,875,124 | B2 | 4/2005 | Gilbert | |
| 6,902,495 | B2 | 6/2005 | Pergande | |
| 6,976,924 | B2 | 12/2005 | Gilbert | |
| 6,991,559 | B2 | 1/2006 | Yabu | |
| 7,070,513 | B2 | 7/2006 | Takeda | |
| 7,083,524 | B2 * | 8/2006 | Daniels | 473/201 |
| 7,192,363 | B2 | 3/2007 | Blankenship | |
| 7,281,989 | B2 | 10/2007 | Hou | |
| 7,303,485 | B2 | 12/2007 | Tseng | |
| 7,303,486 | B2 | 12/2007 | Imamoto | |
| 7,316,623 | B2 | 1/2008 | Imamoto | |
| 7,481,718 | B2 | 1/2009 | Soracco | |
| 7,530,902 | B2 | 5/2009 | Nakamura | |
| 7,563,176 | B2 * | 7/2009 | Roberts et al. | 473/329 |
| 7,588,502 | B2 | 9/2009 | Nishino | |
| 7,621,822 | B2 | 11/2009 | Roach | |
| 7,938,737 | B2 * | 5/2011 | Soracco et al. | 473/329 |
| 7,938,738 | B2 | 5/2011 | Roach | |
| 8,025,589 | B2 | 9/2011 | Brinton | |
| 8,083,611 | B2 * | 12/2011 | Kuan et al. | 473/340 |
| 8,152,651 | B2 * | 4/2012 | Roach | 473/329 |
| 2002/0187845 | A1 | 12/2002 | Kim | |
| 2004/0146714 | A1 * | 7/2004 | McCollum et al. | 428/411.1 |
| 2004/0166959 | A1 | 8/2004 | Chen | |
| 2004/0266553 | A1 | 12/2004 | Park | |
| 2005/0277485 | A1 | 12/2005 | Hou | |
| 2006/0052184 | A1 | 3/2006 | Soracco | |
| 2007/0054590 | A1 | 3/2007 | Schmidt | |
| 2007/0129162 | A1 | 6/2007 | Pan | |
| 2007/0155534 | A1 * | 7/2007 | Tsai et al. | 473/334 |
| 2007/0252115 | A1 | 11/2007 | Arehart | |
| 2008/0009366 | A1 * | 1/2008 | Lo | 473/335 |
| 2008/0076598 | A1 | 3/2008 | Lin | |
| 2011/0009205 | A1 * | 1/2011 | Oldknow et al. | 473/291 |
| 2011/0028236 | A1 | 2/2011 | Takechi | |
| 2011/0108781 | A1 | 5/2011 | Tomasulo | |

FOREIGN PATENT DOCUMENTS

| | | |
|---|---|---|
| JP | 2001-37925 | 2/2001 |
| JP | 2001-79123 | 3/2001 |
| JP | 2001-95959 | 4/2001 |
| JP | 2003-334267 | 11/2003 |
| JP | 2004-313777 | 3/2004 |
| JP | 2006-129936 | 11/2004 |
| JP | 3112038 | 4/2005 |
| WO | 99/20358 | 4/1999 |

OTHER PUBLICATIONS

Momentum Sign iron, brochure, Feb. 2005 (2 pages).
Japanese Office Action with English translation, First re JP Pat. App. No. 2007-225117, Feb. 2, 2010 (11 pages).
Japanese Office Action with English translation, First re JP Pat. App. No. 2007-225117, Oct. 26, 2010 (12 pages).
Japanese Office Action / Decision to Decline, re JP Pat. App. No. 2007-225117, May 10, 2011 (7 pages).
Japanese Office Action / Final Rejection, re JP Pat. App. No. 2007-225117, May 10, 2011 (3 pages).
Office Action re U.S. Appl. No. 12/622,178, May 5, 2010 (19 pages).
Notice of Allowance re U.S. Appl. No. 12/622,178, Jan. 19, 2011 (8 pages).

* cited by examiner

COLORIZED DAMPING INDICATORS FOR CUSTOMIZED GOLF CLUB HEADS

CROSS-REFERENCE TO RELATED APPLICATIONS

This is continuation-in-part of U.S. patent application Ser. No. 13/093,708, filed Apr. 25, 2011, which is a continuation of U.S. patent application Ser. No. 12/622,178, filed Nov. 19, 2009, which is a continuation of U.S. patent application Ser. No. 11/469,621, filed Sep. 1, 2006, now U.S. Pat. No. 7,621,822, which are incorporated herein by reference in their entireties.

FIELD OF THE INVENTION

The present invention relates to golf clubs and more specifically to golf clubs with improved mass properties and vibration damping.

BACKGROUND

Perimeter weighting in iron-type golf clubs distributes non-essential mass of the iron towards the perimeter, reducing the effects that off-center hits have on the golf club and producing more accurate and consistent golf ball trajectories. Perimeter weighting is achieved by creating a cavity in the back of the golf club opposite the face or hitting surface. The material weight removed to create this cavity is redistributed around the perimeter of the golf club head. In general, larger cavity volumes correspond to increased amounts of mass distributed around the perimeter.

Removing material from the rear of the club head, however, reduces the thickness of the club face. Since the club face is the hitting surface, the club face cannot be so thin that the strength of the club face surface is not sufficient to withstand the stress resulting from a golf ball striking the club face. Reducing the thickness of the club face may also increase vibrations upon impact. These vibrations may cause bad feel to the user.

There are various examples of secondary material incorporation into iron golf club heads for vibration damping. Some of these materials provide the additional benefit of displacing weight to the perimeter of the club head so as to increase the club head's moment of inertia (MOI). These materials can provide a variety of different playing characteristics with the result that two clubs that are similar in appearance can in fact be different when played.

Because a playing characteristic of a golf club may not be evident from the shape of the club, the club may not perform the way a golfer expects it to. For example, a skilled golfer accustomed to playing with a club that has little or no damping material may unintentionally make a shot using a club that has a very forgiving damping material and find that the club performs unpredictably. Similarly, two clubs having the same shape may include damping material that provides very different weight distributions such that one of the clubs has a much lower center of gravity. A golfer who unwittingly switches one club for the other midway through a game may find that their next shot launches in an unexpected direction, worsening the golfer's score.

SUMMARY

The present invention is directed to a golf club having a playing characteristic that is communicated to a player based upon a vibration damping material that is colorized and visible from outside of the club head, thereby communicating to a golfer information about the playing characteristics of the club. This construction involves a club body portion having a face insert. There is a hollow area or channel between the face insert and the body portion after the insertion of the face insert. This hollow channel is substantially filled with a heterogeneous viscoelastic material, such as urethane or natural or synthetic rubber, in which at least a portion of the material is colorized and visible from outside of the club head. Suitable colorants include dyes and pigments. The material may further be heterogeneous as to density, thickness, or damping coefficient (i.e., shore hardness, elasticity, or similar measure). Density of a material can be modulated by inclusion of fillers of differing densities. High density fillers include, but are not limited to, metal powders such as tungsten powder. Low density fillers include, but are not limited to, microspheres or voids created by foaming agents. The fillers are partially incorporated into the viscoelastic material so that a lower density portion of the material is located near the top or crown of the club head and a higher density portion is located near the bottom or sole of the club head. This moves the center of gravity of the club head downward and rearward while providing vibration damping. The shape and volume of the channel can also be varied to further modify the weight distribution in the golf club head. The incorporation of this secondary or damping material provides improved feel, improved weight distribution, and enhanced club performance.

In certain aspects, the invention provides a golf club head having a body portion that includes a sole, topline, heel, and toe region which define a perimeter weight. The club head includes a hitting face attached to a front of the body portion and a channel defined by the perimeter weight, at least a portion of the channel having an opening directed only toward a back surface of the face insert. The club head further includes a damping material disposed in at least a portion of the channel, in which an exposed portion of the damping material includes a dye and is visible from an outside of the club head. In some embodiments, a portion of the damping material near the sole has a first density and a portion of the material near the topline has a second density lower than the first density. The sole portion and the topline portion may both be of a different or the same color, with both being exposed to the outside of the club head through an opening or window through the body portion (e.g., one or more window openings near the top line, sole, or elsewhere in the club head body). The window openings can have any shape, for example, elongated and running along a length of the channel, or round, square, elliptical, oval, or any other shape. Each window opening exposes either a portion of the damping material or a part of the interior of the club head, i.e., the inside of the channel.

The exposed portion of material can include a dye or pigment. Preferably, exposed material includes a bright, primary, or fluorescent color or a translucent portion of material (e.g., revealing a portion of the club head behind it). In certain embodiments, the exposed material includes a transparent layer of material (e.g., silicon or urethane) covering a colored underlying material. The material can include areas of different color, for example, where it appears in different windows, or within a single window more than one color can be visible. Any number of different colored regions may be included, such as one, two, three, four, or more.

Colored regions of the damping material are provided to communicate to a golfer information about the playing characteristics of a club head. For example, having a colored damping material can inform a golfer that the club head includes the damping material by making it more visible than un-colored material. The invention provides different damping materials in which a color indicates an amount of damping (for example, a damping coefficient) (e.g., green for soft, orange for intermediate, red for stiff). Including two or more regions of color within a club head can communicate to a golfer that a property of club head varies within that club head. For example, having a dark color near the sole can indicate that weight is concentrated there (e.g., deep blue damping material near sole is high density) while a light color near the top line can indicate that weight is relatively low there (e.g., light blue damping material near top line is low density). Different colors can indicate other heterogeneous properties, such as a thickness or softness of a damping material or a heterogeneous composition in a heel-toe direction, as well as a top line-sole direction. In certain embodiments, the damping material is homogenous in physical properties, but heterogeneous in color to indicate a heterogeneous property of the club head associated with parts of the club head other than the damping material. For example, in certain embodiments, the club head includes weight elements near the sole (e.g., tungsten) and the damping material near the weight element is a different color than the rest to indicate the presence of the weights, thereby communicating to the golfer information about the playability of the club.

The damping material can include any additive or ingredient useful to the playability or durability of the club such as, for example, UV stabilizers or surface coatings. The damping material can occupy an entirety of, or less than an entirety of, the channel. In some embodiments, no material is disposed within an open region of the channel creating a hollow space, wherein the hollow space is exposed by an opening.

In certain aspects, the invention provides a golf club including a colorized heterogeneous damping material disposed in a channel between a club head body and a face insert, in which at least a portion of the damping material is visible from outside of the club head, and in which a mass distribution of the club head is optimized via the heterogeneous material. For example, in one embodiment, the visible colorized heterogeneous material has at least a first region having a first density and disposed in the channel toward the top line of the golf club body and a second region having a second density and disposed in the channel toward the sole of the body. The second density is greater than the first density, thereby lowering the center of gravity while providing vibration damping. When the channel is in the shape of a generally annular or elliptical ring running substantially parallel to the perimeter of the body of the golf club head, the first region of the visible colorized material is disposed in a first portion of the channel adjacent the top line, and the second region of the visible colorized material is disposed in a second portion of the channel adjacent the sole. This annular or elliptical ring can be arranged with uniform dimensions, or the dimensions can be varied. For example, the annular channel can have a first width disposed adjacent the top line and a second width disposed adjacent the sole, such that the second width is greater than the first width. Similarly, the annular channel further can have a first depth in the first width area and a second depth in the second width area, such that the second depth is greater than the first depth. Therefore, a greater amount or volume of visible colorized material can be placed toward the sole and rearward in the club head.

The channel between the club body portion and the face insert may comprise discrete portions, with at least one portion containing lower density viscoelastic material and at least another portion containing a higher density viscoelastic material.

In certain aspects, the invention provides a method of providing information about a playing characteristic of a golf club through a visual aspect of the golf club. Preferably, information about the playing characteristic is communicated by an appearance of the portion of the club that bestows the club with the playing characteristic (e.g., a color). The method includes colorizing at least a portion of a damping material and assembling a club head including the material. A colored portion of material can provide information to a golfer about a playability of the club head. For example, a color of the damping material can be associated with a damping coefficient or density.

In certain embodiments, the invention provides methods of a providing a golf club that includes a material having at least a portion custom colorized for a golfer. Methods of the invention include receiving order information from a customer about a golf club and about a color and assembling a golf club including a material having a color indicated by the color information. The invention further provides methods of providing a set of golf clubs having a colorized element in common among all of the clubs of the set, creating an identity for the set that is useful for showing ownership, reducing loss or theft, and assisting a golfer in selecting the appropriate club for making a shot.

DETAILED DESCRIPTION

Figure 1:
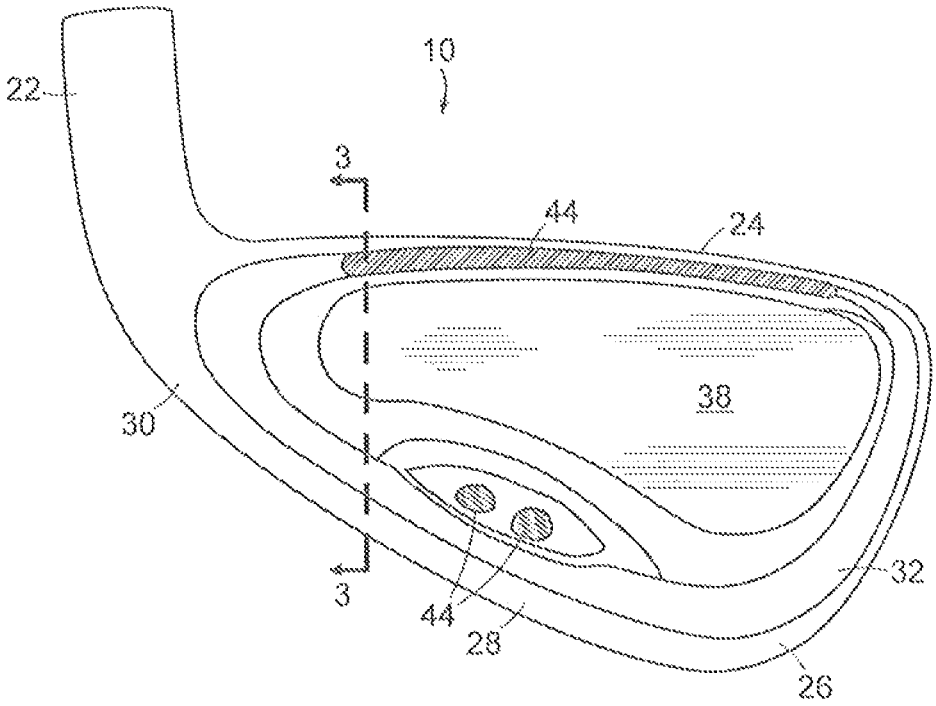
FIG. 1 is a first perspective rear view of an embodiment of the golf club heads of the present invention.
Figure 2:
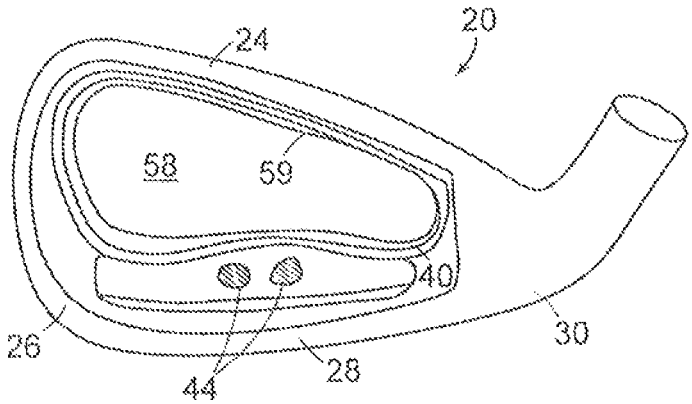
FIG. 2 is a perspective front view of the club body portion without the hitting face.

Referring now to the accompanying figures, exemplary embodiments of the golf club head 10 in accordance with the present invention include body portion 20 (FIGS. 1 and 2) connected to hosel 22. Hosel 22 is adapted to receive a shaft (not shown). The club head 20 is preferably cast or forged from suitable material such as stainless steel, carbon steel or titanium. Body portion 20 includes top line 24, toe 26, sole 28 and heel 30 that form the perimeter of body portion 20. Hosel 22 extends generally from heel 30 of body portion 20. Club head 10 is preferably a cavity back club; therefore, body portion 20 includes rear perimeter 32 extending from the back of the club head and running along its perimeter. The portion of perimeter weight 32 along sole 28 is larger/thicker to move the center of gravity downward and rearward. Arrangements for perimeter weighting are generally known in the art.

Figure 3:
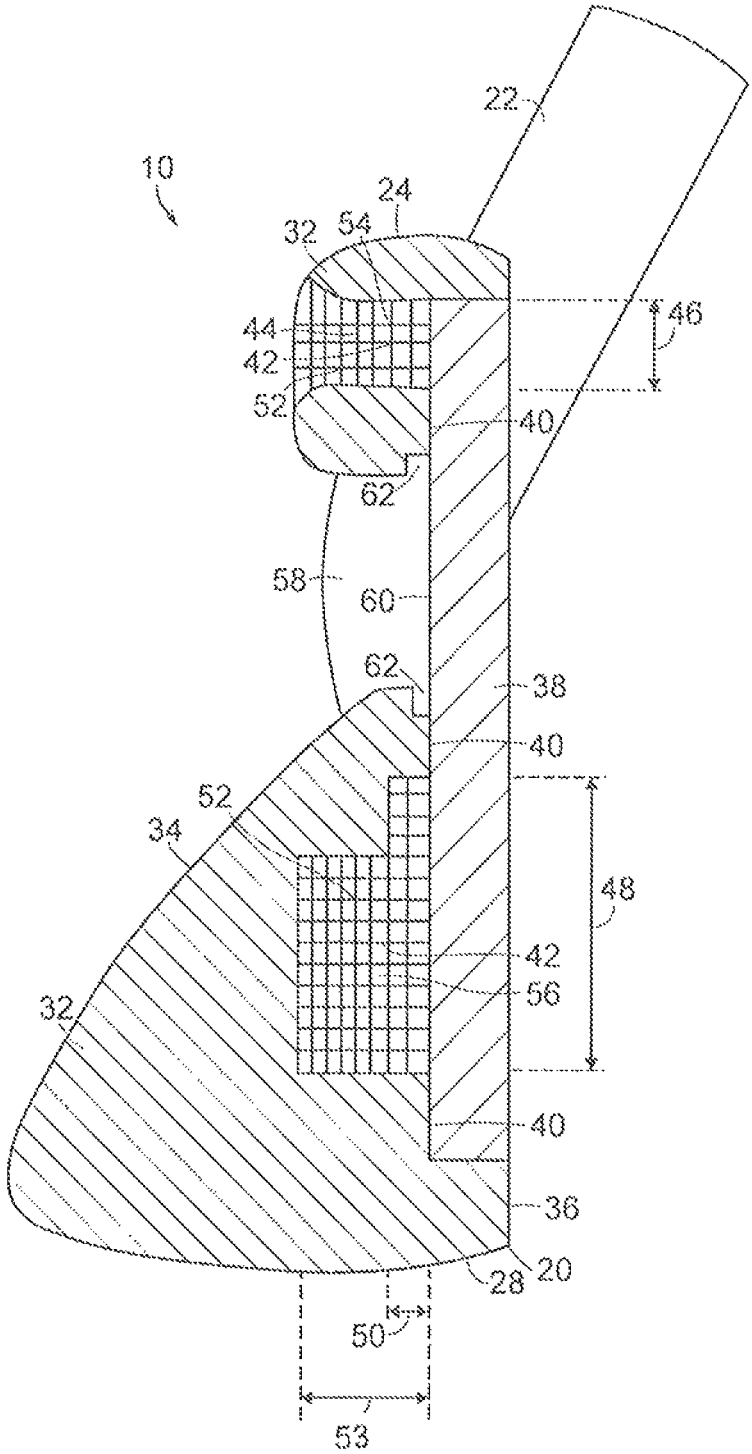
FIG. 3 is a cross-sectional view through line 3-3 of FIG. 1.

As is shown in FIG. 3, club head 10 also includes face insert 38 attached to the front 36 of body portion 20. Suitable materials for face insert 38 include stainless steel, preferably a high-strength steel material, and non-steel materials such as titanium and metal matrix composites (MMC). Face insert 38 forms the club face or hitting surface of club head 10. Suitable methods for attaching face insert 38 to body portion 20 include, but are not limited to, welding, swaging, press fitting, hot isostatic pressing and attachment using bonding agents or adhesives. In one embodiment, face insert 38 is attached to body portion 20 by laser-welding face insert 38 to cast body portion 20 of the golf club. Face insert 38 is in contact with and supported by body portion 20 at one or more support 40. In other areas, face insert 38 is spaced from body portion 20 to define channel 42 disposed between at least a portion of face insert 38 and body portion 20. In one embodiment, channel 42 can be completely enclosed between body portion 20 and face insert 38. Channel 42 is adapted to receive a secondary or damping material.

In one embodiment, hollow or channel 42 is not completely enclosed but is arranged to have one or more open areas or openings 44 to the back cavity. Openings 44 can be positioned near top line 24 or sole 28, and can be an elongated channel or circular shape. These open areas or openings allow any secondary material disposed in the channel to be visible to the user. The open areas can function as windows, revealing a portion of the channel within, or a portion of a damping material disposed within the channel. This allows a club manufacturer to easily communicate in an intuitive way information about a property of the club such as a property of a damping material within channel 42. Channel 42 can be formed as a uniform channel or can vary in size and shape. In one embodiment, channel 42 forms a generally annular shape running substantially parallel to rear perimeter 32. In one embodiment, channel 42 between face insert 38 and cast body 20 extends from about 45° to about 360° around the perimeter of the face of the golf club. Channel 42 may comprise several discrete portions. In one embodiment, the width of this annular channel is varied. For example, annular channel 42 can have first width 46 disposed adjacent top line 24 and second width 48 disposed adjacent sole 28. In one embodiment, second width 48 is greater than first width 46. In addition, the depth of the annular channel can be varied. For example, channel 42 can include first depth 50 and areas of second depth 53, such as at openings 44 as shown in the cross-sectional view of FIG. 3, in first width 46 area or other areas disposed toward top line 24 and second depth 51 in the second width 48 area. Second depth 53 is greater than first depth 50. Varying the depth and width of channel 42 varies the volume of channel 42 and the amount of channel 42 in contact with face insert 38.

Damping material may also be provided as a body or sheet opposing (i.e., fixed onto the back of) face insert 38, optionally being heterogeneous in thickness, density, color, or damping coefficient. Damping bodies are shown in U.S. Pat. No. 7,192,363; U.S. Pat. No. 5,290,036; and U.S. Pub. 2011/0028236, the contents of which are hereby incorporated by reference in their entirety.

One or more of opening 44 can be included facing to the back of the club, up, down, in a heel or toe direction, forward, or in any direction. In some embodiments, one or more opening 44 is open in an upward direction when a club is at address, and a golfer holding the club at address can see a portion of a damping material through the one or more opening 44. For example, in some embodiments, two openings are positioned near a top line of a club head and between about 20 mm and about 60 mm apart, preferably between about 40 mm and about 50 mm apart, e.g., about 43 mm apart. Each of the two openings reveals to a golfer a portion of a colorized damping material, and thereby provide the golfer with a visual alignment aid. For example, the two upward facing openings can be centered around a sweet spot on the striking face of the club head. As an alignment aid, the club head can also optionally have an opening directly above a sweet spot on a strike face.

In order to damp vibration and improve weight distribution, heterogeneous material 52 is disposed in at least a portion of channel 42. The material 52 is heterogeneous in that the composition and density of material 52 is varied depending on its location within channel 42. In one embodiment, heterogeneous composite material 52 is disposed in the entire channel 42. In general, the composition, e.g., the density, of composite material 52 is varied in order to shift more weight downward and rearward, thereby moving the center of gravity of golf club head 10 downward and rearward as well. Therefore, the portion of composite material 52 located toward top line 24 is formulated to have lower density, and the portion of composite material located toward sole 28 is formulated to have higher density. The volume and configuration of channel 42 can also be used to improve the weight distribution. For example, the channel is arranged to be larger or to extend farther rearward in areas located near the sole of the club head. In one embodiment, heterogeneous composite material 52 contains first region 54 having a first density and disposed in channel 42 toward top line 24 of body portion 20. The composite material also includes second region 56 containing second density and disposed in channel 42 toward sole 28 of body portion 20. The second density is greater than the first density.

A composite material or damping material according to the invention can be described in terms of a damping coefficient. A high damping coefficient material includes materials with good viscoelasticity such as, for example, Sorbothane viscoelastic polymeric solid from Sorbothane, Incorporated (Kent, Ohio). In some embodiments, a material with a low damping coefficient such as, for example, rubber is provided. For some golfers, a damping property is a matter of comfort, personal taste, or playing ability. The invention provides a golf club that has different damping properties depending on the damping coefficient of the material used for a damping material disposed in a channel.

Suitable methods for introducing or attaching the damping material to the channel include, but are not limited to, pouring or injecting the damping material into the hollow area after face insert 42 is welded to the body, for example through openings in the back of the body portion. The face insert can also be crimped into place, allowing the heterogeneous composite material to be molded separately and placed into the cast body before crimping, providing the benefit of ease of manufacture. The molded material can be press fit or attached using a bonding agent such as glues or epoxies. Alternatively, the composite material can be poured or injected into the hollow area before face insert 42 is installed, as with laser-welded attachments.

In a preferred embodiment, channel 42 is arranged with a generally annular shape that runs substantially parallel to the perimeter of body portion 20. In this arrangement, first region 54 of composite material 52 is disposed in a first portion of channel 42 disposed adjacent top line 24, and second region 56 of composite material 52 is disposed in a second portion of channel 42 adjacent sole 28. In this embodiment, composite material 52 substantially fills the entire channel 42, providing contact with face insert 38 throughout the channel area.

The heterogeneous material is selected to enhance weight distribution and vibration damping. In one embodiment, the heterogeneous composite material includes a viscoelastic material. Suitable viscoelastic materials include, e.g., polyurethane, natural or synthetic rubbers, other elastomers, epoxies, and combinations thereof. Preferably, the heterogeneous composite material includes a polyurethane made from a polyol and a polyisocyanate. In general, any viscoelastic material can be used. If the heterogeneous material is to be poured or injected, the material should have a low viscosity, minimal shrinkage rate and quick set-up time to allow for ease of manufacturing. Suitable materials include silicone rubbers such as RTV-627, which is commercially available from MG Chemicals of Surrey, B.C., Canada.

Changes in the weight or density of the heterogeneous material to achieve heterogeneity are achieved by adding fillers to the material. These fillers can either decrease, e.g., glass beads, micro-spheres or voids created by foaming agents, or increase, e.g., metal powders, the density of the composite material. Suitable fillers include, but are not limited to, carbon graphite, metal fibers, zinc oxide, barium sulfate, calcium oxide, calcium carbonate and silica, as well as the other well-known corresponding salts and oxides thereof, foaming agents, glass spheres, metals and combinations thereof. Preferably the additive or filler is a metal powder. Suitable metal powders include, but are not limited to, tungsten, magnesium, titanium and aluminum. Preferably, the metal powder has high density such as tungsten powder, producing, for example, a tungsten-filled silicone rubber. The amount of filler is selected based upon the desired density distribution requirements. In one embodiment; upper portion 54 contains un-filled viscoelastic material and lower portion 56 contains high density metal-filled viscoelastic material.

Additional components that can be added to the heterogeneous material include UV stabilizers and other dyes, as well as optical brighteners and fluorescent pigments and dyes. Such additional ingredients may be added in any amounts that will achieve their desired purpose. In general, "colorized" refers to a material to which a pigment or dye has been added with the purpose of giving that material a color. In certain embodiments, pigments are added, e.g., as identified by an index number provided by the Color Index International (CII) published by the American Association of Textile Chemists and Colorists (Research Triangle Park, N.C.). Suitable pigments include pigments based on cadmium, chromium, cobalt, copper, iron oxides, mercury, titanium, ultramarine, or similar such as, for example, cadmium yellow, carbon black, cobalt blue, azurite, venetian red, caput mortuum, Naples yellow, titanium white, or Phthalocyanine Green G. Pigments are available from Prisma Colour (Chisworth, Derbyshire, UK). Suitable elastic materials, pigments, and colorized materials are available from Wacker Chemie (Munchen, Germany). In certain embodiments, damping material 52 is colorized to match an exterior surface of a golf club, for example, to make a substantially monochrome golf club. Damping material may also be provided that is translucent, for example, by silicon or urethane including a pigment to produce a translucent material.

As shown in the figures, club body portion 20 also includes central opening 58 having perimeter 59 that generally parallels the perimeter of body portion 20. Opening 58 exposes back surface 60 of face insert 38 to the back of the club head. Adjacent perimeter 59 of opening 58 is contact surface 40 that is in contact with face insert 38. In one embodiment, step or space 62 runs along perimeter 59 and is spaced from contact surface 40, as shown in FIG. 3. This provides a gap that can be used to inject the heterogeneous composite materials 52.

Exemplary embodiments of golf clubs having the face insert, cast body and heterogeneous viscoelastic material in accordance with the present invention provide improved feel due to the damping provided by viscoelastic material 52 confined in channel 42 disposed between body portion 20 and face insert 38. The damping material is in contact with and is located directly behind the hitting area, as well as around the perimeter of the face, where significant vibration could occur. By removing weight from the topline and upper perimeter and replacing it with lighter viscoelastic material and by adding high density filler to the viscoelastic material near the sole, the center of gravity is lowered. Arrangements in accordance with the present invention can be used with various types of golf clubs includes irons, putters and wedges.

Golf clubs in accordance with exemplary embodiments of the present invention allow for damping material to be placed around the entire perimeter of the face, if desired, or to be isolated to specific areas of the club head such as only the top line or only the high or low toe area. In addition to the mass property and vibration damping benefits, the channel may have a unique appearance if part of the channel is left exposed. The exposed area would create a window or series of windows through which the viscoelastic material can be seen. One or more windows in conjunction with colorized viscoelastic material of one or more colors provides a number of useful benefits to a club head.

Color in a club head provides a number of useful benefits and functional advantages. Color enables a club head to be identified. If multiple players have clubs that are similar but for a unique color, each player can easily spot their own clubs. Color makes a club much easier to spot, for example, from a distance or in diminished light conditions. Color can indicate a property of a club head (loft, damping, shaft flex, etc.).

Damping material according to the invention may be colorized with any color, including any hue, or fluorescent or day-glow colors, as well as novelty effects and finishes, such as metallic flake, marbleized or tie-dyed affects, or photochromic or thermochromic material (see, e.g., material described in U.S. Pat. No. 5,503,583; U.S. Pat. No. 4,425,161; and U.S. Pub. 2007/0252115, the contents of each of which are herein incorporated by reference in their entirety). The term "photochromic" generally refers to a reversible change of color under exposure to light, for example by a chromene or a silver halide salt. Photochromic materials are discussed in U.S. Pat. No. 4,927,180; U.S. Pub. 2011/0108781; U.S. Pub. 2007/0054590; and U.S. Pub. 2004/0266553, the contents of which are hereby incorporated by reference in their entirety. In certain embodiments, a golf club is provided having a damping material disposed in a channel with a portion visible from outside of the club that is a color of high visibility such as, for example, a bright color like yellow, a day-glow color or fluorescent color, or similar. Such a color makes a golf club that is easier to see in low light conditions and easy to pick out from among a number of clubs. A golfer benefits by having a distinctive, easy to see and easy to find golf club. The color is provided in the club by colorizing a damping material, for example, disposed between a face plate and a club head body.

A damping material improves the playability of a club when disposed in a channel between different hard parts of a club, such a channel separating a striking face from a body. The damping material can be made visible from outside of the club by leaving a portion of the channel open—even if another portion of the channel is fully enclosed.

Use of a damping material in a club head creates an opportunity to add color to a club head in an inexpensive way. It is easier to impregnate a damping material with pigments than the surrounding material (e.g., steel, titanium, etc.). It is also less expensive to add color to a club head in an elastic material than throughout the club head. Known methods of coloring golf clubs—see, for example, U.S. Pub. 2008/0076598—can involve complex, multi-layer finishes that are expensive to apply and not suited to a variety of club head materials. The strike plate and surrounding body may be formed of expensive metal alloys manufactured in once process (e.g., forged, cast, direct laser metal sintered), but the club head can be assembled with an elastic material that is dyed and poured in during assembly, or pressed into a channel after. Accordingly, a manufacturing mistake during a colorizing step does not waste an entire metal club head as the color damping material can be thrown away and the metal components can be used again to assemble a club head.

A benefit of colorizing a portion of a club is that it provides the ability to communicate information about a club in a manner that can be very intuitive and straightforward. Clubs can be provided wherein different colors indicate a property of each club. For example, clubs can be color coded by damping coefficient or by loft setting. Including color material that communicates something about a club helps golfers on the course quickly pick the right club for the shot (e.g., high loft clubs include blue for sky, low loft clubs include green for grass, etc.). Coloring the material emphasizes the special vibration damping properties of the club. Color is discussed in U.S. Pat. No. 8,025,589 and U.S. Pub. 2002/0187845, the contents of which are hereby incorporated by reference in their entirety.

In certain embodiments, the invention provides methods for making a club with a color portion. Methods of the invention include assembling a club head including a body, a face insert, and a damping material, wherein the assembled club head includes a channel having the damping material disposed therein. A window or opening to the channel can be provided to reveal a portion of the damping material to an exterior of the club. Methods further include colorizing all or a portion of the damping material with a dye or pigment.

By colorizing the damping material and exposing the colored material to the outside of the club head, methods of the invention solve the problem of communicating properties of a club head to golfers. In certain embodiments, a golf club is provided that is offered in a variety of damping levels provided by a variety of materials and each material is colored to indicate its damping level. Thus, a very soft material with good damping may be colored green and a very stiff material with only subtle damping may be colored red.

In certain embodiments, a color portion of a golf club is customized. Providing a customized golf club includes receiving information from a customer about a golf club, such as a type, a material, or an effective setting for loft or a shaft length and receiving information about a color. Information about a color can be received in the form of a digital photo, a specimen, a description, input into a computer system (e.g., an HTML color picker), a pantone number, or a choice from a catalog (e.g., implemented as a pull-down menu in a computer interface). Methods of providing a customized color can include custom colorizing a component to be assembled into a club head such as, for example, the damping material. In some embodiments, a previously assembled club head is colorized or custom colorized by replacing a damping material in the club head with a colorized damping material.

In some embodiments, a customer's entire set of diverse club (e.g., irons and wedges) can have a color element in common, creating a unifying theme. Theft is more difficult, as is accidental loss, because the custom color is associated with the correct owner. The invention further provides methods of providing a customized set of golf clubs wherein each club has a color element in common, for example, a colorized damping material.

A damping material can be heterogeneous as to color or as to a physical property, such as density, porosity, pliability, modulus, hardness, or elasticity. Providing a club with a higher damping coefficient (e.g., softer, more elastic damping material) makes a club softer and more pleasant to play with. In some embodiments, the damping coefficient in a club head is varied within or throughout a channel. For example, a low damping material is positioned near a sole and a high damping material is placed near a top line.

In some embodiments, the density of the damping material remains substantially the same throughout, and the damping material is made from a composite material, such as a viscoelastic material with fillers, as described in details above. In one example, the viscoelastic material comprises polyurethane and the filler comprises low density micro-spheres or high density metal powders. The option of using low density or high density fillers provides golf club designers with additional degrees of freedom to locate the center of gravity at desired locations, to size the sweet spot of the golf clubs, and to adjust MOI as desired.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head, comprising:

a body portion comprising a sole, topline, heel, and toe;

a hitting face insert attached to a front of the body portion;

a channel formed along a portion of the body portion, at least a first portion of the channel having an opening directed only toward a back surface of the face insert; and a damping material disposed in at least the first portion of the channel and in contact with the back surface of the face insert, wherein an exposed portion of the damping material includes a colorant and is colorized by the inclusion of the colorant and is visible from an outside of the club head, wherein the colorant provides visual information indicative of one or more playing characteristics of the club head, the visual information selected from the group consisting of a damping property of the damping material, density of the damping material, weight placement along the club head, weight distribution along the club head, and loft setting of the club head.

2. The golf club of claim 1, wherein a first portion of the damping material near the sole comprises a material having a first density and a second portion of the damping material near the topline comprises a material having a second density lower than the first density.

3. The golf club of claim 2, wherein the first portion has a first color and the second portion has a second color different than the first color and both first and second portions are visible from outside of the club head through one or more openings defined along the body portion.

4. The golf club of claim 2, further comprising:

a third portion of the damping material disposed in at least a portion of the channel, wherein the third material is different from the first and second portions.

5. The golf club head of claim 4, wherein the third material is disposed in only a lower portion of the entire channel near the sole of the body portion.

6. The golf club head of claim 5, wherein the third material has a greater density than the first and second materials.

7. The golf club head of claim 5, wherein the third portion comprises tungsten.

8. The golf club head of claim 5, wherein the second and third portions of material comprise UV stabilizers.

9. The golf club of claim 1, wherein the exposed portion is visible through an opening defined along a back of the club head.

10. The golf club of claim 9, wherein the opening is near the topline.

11. The golf club of claim 9, wherein the opening is near the sole.

12. The golf club of claim 1, wherein the exposed portion is visible through an elongated opening defined on the body portion.

13. The golf club of claim 1, wherein the exposed portion is visible through a circular opening defined on the body portion.

14. The golf club of claim 1, wherein the exposed portion comprises a transparent material covering a colored underlying material.

15. The golf club of claim 1, wherein the colorized portion of material includes a fluorescent pigment.

16. The golf club of claim 1, wherein the damping material further comprises a second exposed colorized portion of a different color than the first portion and visible from an outside of the club head.

17. The golf club head of claim 16, wherein the second portion is disposed in only a lower portion of the entire channel near the sole of the body portion.

18. The golf club head of claim 1, wherein the second portion of material is disposed in only an upper portion of the entire channel near the topline of the body portion.

19. The golf club of claim 1, further wherein no material is disposed within an open region of the channel creating a hollow space, wherein the hollow space is exposed by an opening.

* * * * *